United States Patent [19]

Bäumler

[11] 4,261,507

[45] Apr. 14, 1981

[54] SEPARATING CENTRIFUGE

[75] Inventor: Jürgen Bäumler, Osterode, Fed. Rep. of Germany

[73] Assignee: Heraeus-Christ GmbH, Osterode, Fed. Rep. of Germany

[21] Appl. No.: 79,307

[22] Filed: Sep. 26, 1979

[30] Foreign Application Priority Data

Nov. 11, 1978 [DE] Fed. Rep. of Germany ..... 2848953

[51] Int. Cl.[3] ..... B04B 1/02

[52] U.S. Cl. ..... 233/23 R

[58] Field of Search ..... 233/16, 17, 18, 23 R, 233/24, 25, 1 R, 28, 34

[56] References Cited

U.S. PATENT DOCUMENTS 2,822,127 2/1958 Sinn ..... 233/17 X

FOREIGN PATENT DOCUMENTS 2354368 5/1974 Fed. Rep. of Germany .

*Primary Examiner*—Christopher K. Moore

*Attorney, Agent, or Firm*—Frishauf, Holtz, Goodman & Woodward

[57] ABSTRACT

To prevent uneven rotary speeds of the inner rotor of a nested triple-rotor centrifuge in which a separating container is located in an inner rotor and connected by means of soft-elastic integral connecting tubes with the outside of the centrifuge, and without slip joints, and wherein the three nested, coaxially positioned rotors are independently rotatable with respect to each other, a positive synchronizing drive connection (25, 33) is established between the outer rotor (4) and the drive connection (27, 28, 29, 30, 31, 32) of the inner rotor (6); the centrifuge is particularly suitable for centrifuging blood during or immediately following blood donation to permit separation of blood plasma and return of erythrocytes to the donor.

14 Claims, 5 Drawing Figures

SEPARATING CENTRIFUGE

The present invention relates to a separating centrifuge, and more particularly to a centrifuge to separate particles suspended in a liquid, especially for biological substances such as blood, in order to separate blood plasma from erythrocytes. The apparatus is particularly suitable for use directly with blood donation programs and for immediate return of the erythrocytes to a blood donor after a blood donation.

BACKGROUND AND PRIOR ART

It has previously been proposed to construct centrifuges in such a manner that a flexible bag is supported in a rotor which is connected to one, or more flexible conduits which, during operation, flex in re-entrant loops or bights, thereby eliminating rotary joints and the like. In one such construction, described and proposed in detail in patent application Ser. No. 930 389, filed Aug. 2, 1978, Westberg, entitled "Apparatus for Accomplishing Unlimited Relative Rotation of the Ends of a Filiform Transmission Element", and corresponding to German Published Patent Disclosure Document No. OS 23 54 368, a plurality of coaxial, nested rotors are independently driven. The rotor structure of the present invention is an improvement over that described in the aforementioned application. Other rotary structures which permit connection to filiform elements, without rotary joints, are described in the referenced patents.

The centrifuge has three independent rotors, nested within each other, the innermost rotor supporting and retaining the separating container in which the liquid, typically blood, is to be placed and, from where, upon separation, the separated components drawn off. The axes of rotation of the respective rotors are all aligned in a straight line along the common central axis of the rotors. The outermost rotor is driven by a motor, for example by a belt drive; the intermediate rotor is connected by a slipfree connection with the outer rotor to be driven therefrom in a direction of rotation opposite to that of the outer rotor. The inner rotor is driven by means of a flexible, torque-transmitting element, such as a spiral spring, or an elongated spiral arrangement. The elongated spiral also receives a multiple channel or duct tubular element of flexible plastic, which forms the connection to the separating container. Upon rotation of the outer rotor, driven by the motor, the intermediate rotor will rotate in an opposite direction, for example with the same speed. The inner rotor is driven at a speed which is a multiple, typically the four-fold mutliple of the other two rotors, driven by the spiral. This arrangement, described, for example, in the aformentioned patent application and published German Patent Disclosure Document No. DE-OS 23 54 368, has the advantage that rotary joints or couplings which are both liquid-tight while permitting relative rotation can be avoided.

It has been found that different torsional relationships of the spiral, friction, and preferential direction of bending will result in rotation of the inner rotor at speeds which vary and are not always constant; rather, the rotary speed of the inner rotor changes in accordance with instantaneously existing frictional conditions, bending conditions of the spiral, or the like, resulting in a superimposed change or modulation of the average speed of the rotor, that is, either leading or trailing of the inner rotor with respect to an average position which would be determined by an average speed. Transmission of torque by means of a spiral, particularly a flexible spiral spring, is limited. Thus, the starting time and braking time have to be comparatively long in order to permit transmission of sufficient torque from the outer rotor to the innermost rotor for acceleration thereof.

THE INVENTION

It is an object to improve a centrifuge structure in which a centrifuging container is connected through flexible conduits, without rotary joints, for circulation of liquid during operation and, more particularly, to so construct such a centrifuge that the drive, particularly for the inner rotor, will be free of slip and at a uniform rotary speed.

Briefly, in accordance with the invention, a synchronizing drive connection is established between the outer rotor and a drive connection in engagement with the inner rotor, for example by a connecting pin, so that the inner rotor can be positively driven as well.

Preferably, the drive connection uses gears and/or ribbed or toothed gear belts or chain belts for positive drive connection between the motor and the respective elements. In accordance with a feature of the invention, the drive wheel or drive gearing, which may include a drive train of the innermost rotor, is coupled to the outer rotor.

The structure is particularly adaptable for separation of blood during, and shortly after donation of blood by a blood donor, and permits ready removal of the blood container from the innermost rotor; the innermost rotor, preferably, is seated on a flanged disk with a dovetail connection thereto, in which the interengaging elements are movably arranged and externally accessible, for example by means of spring-loaded scissor-type handles, so that, during rotation, the rotor is firmly seated, but, after having been stopped, the innermost rotor can be easily removed from the assembly by operating the scissor-type handles.

DRAWINGS

Illustrating a preferred example, wherein.

Figure 1:
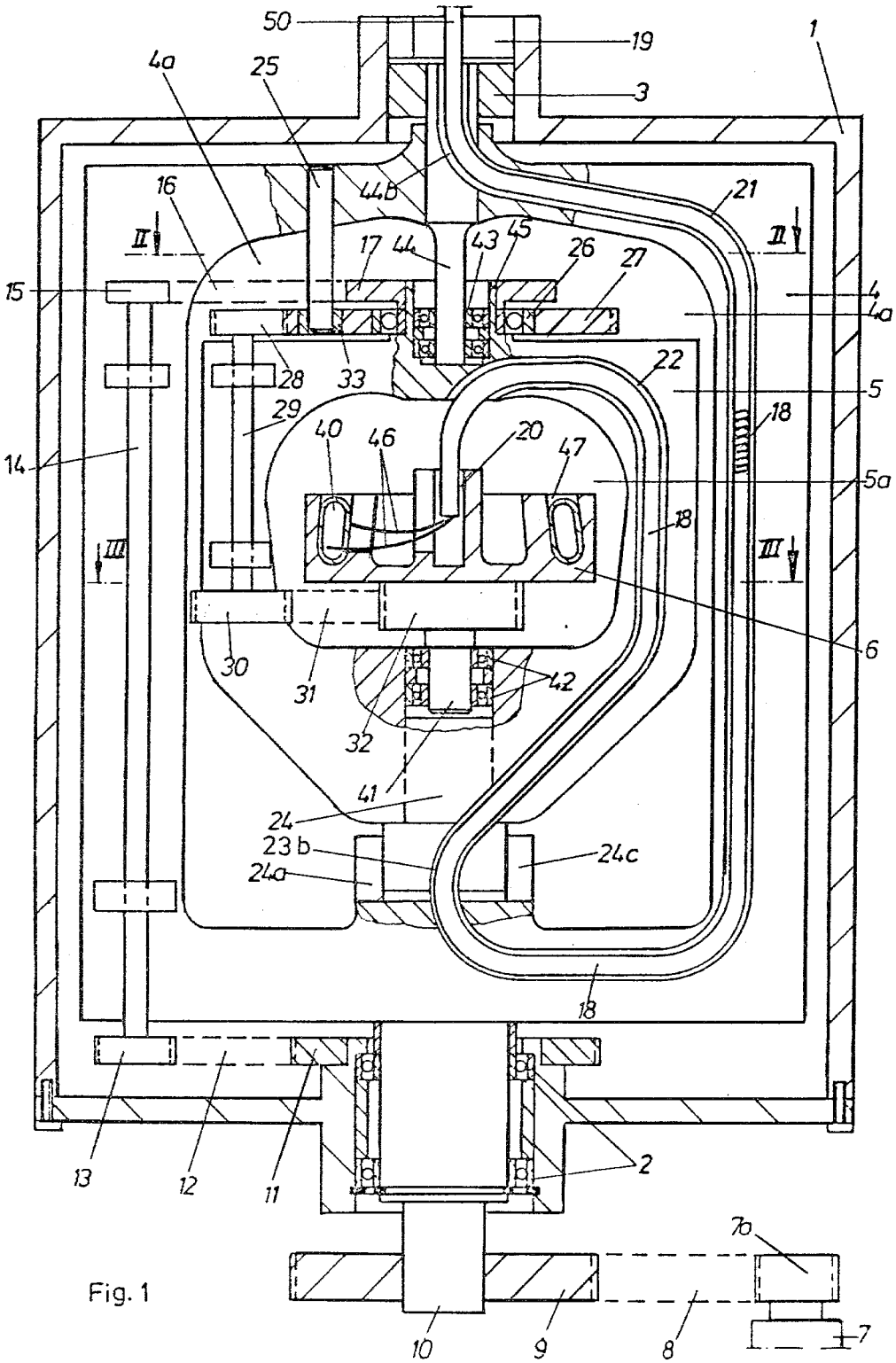
FIG. 1 is a highly schematic longitudinal part-sectionalized view through the centrifuge.
Figure 2:
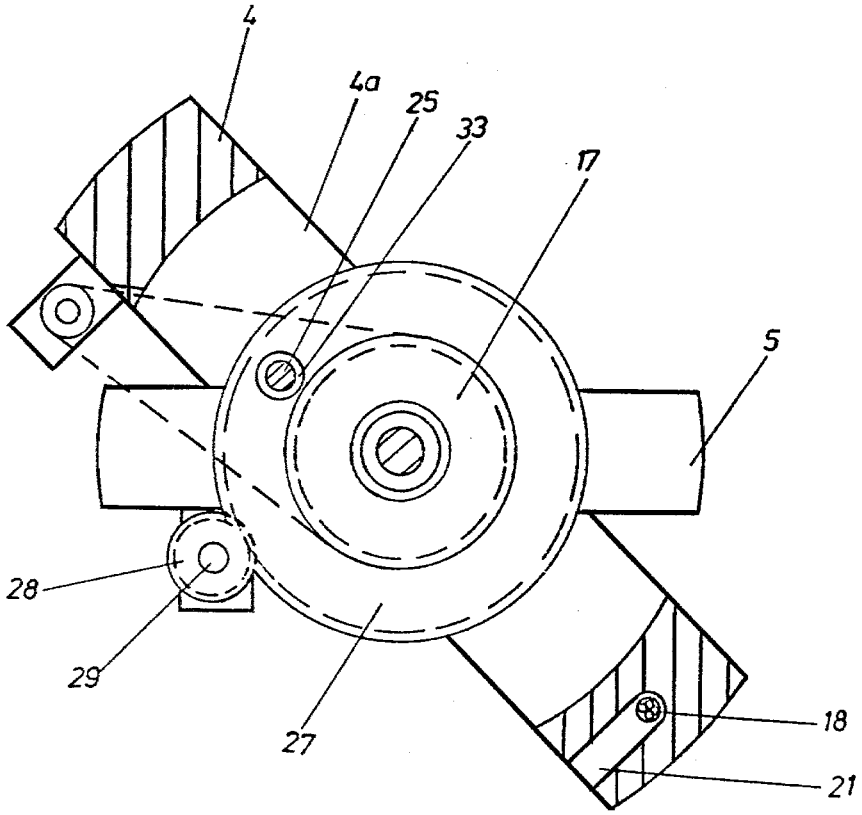
FIG. 2 is a section along the line II—II of FIG. 1.
Figure 3:
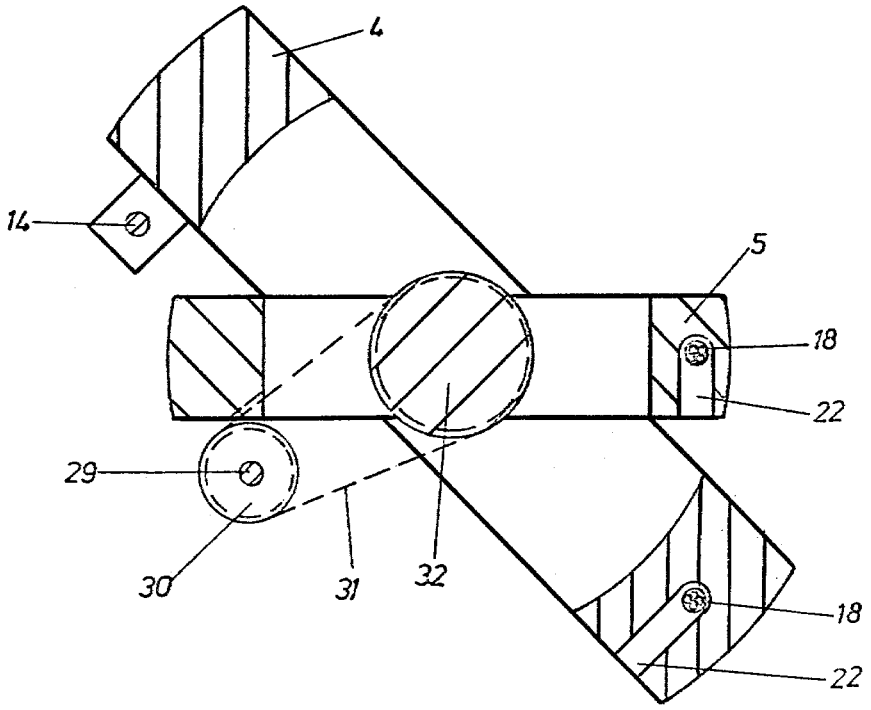
FIG. 3 is a section along line III—III of FIG. 1.

A housing 1 surrounds an outer rotor 4 which, in the preferred form, is formed in the shape of two opposed plate or disk-like C-bows. The cross section of the rotor is best seen in FIGS. 2 and 3. The outer rotor 4 is supported in the housing by a lower radial bearing 2 and an upper radial bearing 3, positioned in vertical alignment within the housing 1. The lower bearing 2 actually is constructed in the form of two axially aligned ball bearings; the upper bearing 3 is a longitudinally split journal bearing. The outer rotor 4 surrounds an intermediate rotor 5 which is somewhat smaller, fitting within the outer rotor, and, like the outer rotor, may be constructed of plate or disk-like elements which are generally C-shaped bows, facing each other. The cross section of the intermediate rotor 5 is best seen in FIG. 3. The intermediate rotor 5 rotates within the inner space or opening 4*a* of the outer rotor 4 about the same axis of rotation, that is, the central axis of all the rotors and of the housing 1. The intermediate rotor 5 is formed with a central opening 5*a*, within which the inner rotor 6 is rotatable, about the same central axis. The inner rotor 6 is formed with a central opening 47 which, essentially, is rotation-symmetrical and receives a generally ring-shaped separating container 40 made of flexible plastic. The biological substance, typically blood, is conducted within the container 40. The cross section of the container 40 is essentially O-shaped—see FIG. 1. The shapes of the openings 4*a*, 5*a* in the disk or plate-like rotors 4, 5 are clearly seen in FIG. 1.

The outer rotor 4 is driven from a motor 7 by a belt pulley 7*a* secured to the motor 7, a belt 8, and a pulley 9 secured to a shaft 10.

The intermediate rotor 5 is driven, slipfree, by a gear disk 11 secured to the housing 1, and fixed in position. A ribbed gear or chain belt 12 is looped over the fixed gear 11, and over a pinion 13 which is secured to a shaft 14, suitably journalled within the outer rotor 4, and connected to a second pinion 15 at the other end of shaft 14. Pinion 15 is connected to a serrated or ribbed belt or chain drive 16 which, further, is looped over a gear 17. Gear 17 is attached to a bushing 45, which is attached to the intermediate rotor 5. The intermediate rotor 5 is driven with the same speed as the outer rotor 4, but in a direction opposite to that of the outer rotor. The intermediate rotor 5 rotates within the opening or space 4*a* of the outer rotor 4 about a vertical axis which is in alignment with the central axis of the entire structure and of all the rotors.

The intermediate rotor 5 is rotatably secured within the outer rotor. In the lower portion of the intermediate rotor 5, a pin 24 extending downwardly is secured thereto, the end 24*a* of which is positioned in a journal bearing formed of two axially split bearing halves or segments, of which only one bearing segment 24*c* is visible, the other bearing segment having been omitted from the drawing for clarity. The upper region of the intermediate rotor 5 is rotatably journalled by a bearing pin 44 fixedly secured to the outer rotor 4 and retaining a ball bearing 43 at the lower end thereof, which ball bearing is also retained within the intermediate rotor 5 to rotatably hold the rotor in axial alignment with the central axis.

The inner rotor 6 is rotatably radially secured by a shaft 41 seated in bearings 42 which are, in turn, positioned in the intermediate rotor 5 for axial and radial bearing thereof.

In accordance with the invention, the inner rotor 6 is driven positively by the outer rotor by means of a pin 25 which is secured to the outer rotor and which extends, with its free end, into a gear 27, so that gear 27 will rotate with the same angular speed and in the same direction as the outer rotor 4. The gear 27 is formed with an eccentrically positioned bushing 33 into which the pin 25 extends. The bushing 23 is constructed to be resilient to provide a floating connection with the pin 25 in order to compensate for manufacturing tolerances.

Gear 27 is journalled on the outer side of bushing 45 which is secured to the rotor 5 by a ball bearing 26, that is, it is concentric with the gear 17 which, in turn, is driven by belt 16, pinion 15, shaft 14, pinion 13, and belt 12, from the gear 11 and hence, by relative rotation of the axis of the shaft 14, transmits rotary torque from the motor 7 over belt 8 and pulley 9 and shaft 10. The gear 27, coupled to the rotor 4 by the pin 25, is in engagement with a gear pinion 28, secured to a shaft 29 which, in turn, is secured to a pinion 30, about which a ribbed drive belt or drive chain 31 is looped, in engagement with a gear 32, in order to provide a rotary connection between the outer rotor 4, via pin 25, gearing 27-28-29-30-31-32, to the inner rotor 6, for positive drive thereof.

The pairing of the gears 27, 28, as well as the positive gear or chain drive 30, 31, 32, and the cross connection by the shaft 29, are so selected that the inner rotor 6 will rotate in the same direction of rotation as the outer rotor 4 and the inner end 20 of the duct housing or cover 18. The separating container 40 is connected to individual tubes 46 which are all surrounded by the duct housing 18. The duct housing 18, preferably, is soft, elastic rubber, a plastic, or a textile braid, or the like, and is positioned within notches or openings 22 of the intermediate rotor 5 and notches or openigs 21 of the outer rotor 4 in order to ensure a connection to the outside. The inner end of the duct housing is essentially vertical; the outer end 50 of the duct housing 18 is guided in a guide bushing 19 in an upper neck portion of the housing 1. The shaft 24 and the bearing pin 44 have respective grooves or other openings for the cover 18 and the connecting tubes 46 located therein, as shown, respectively, at 23*b* and 44*b*. The respective tubes 46 can be connected to different containers, as well as to a blood donor beyond and outside of the centrifuge, as will be described in detail below.

The separating container 40 can be readily placed within the inner rotor 6, and can be easily removed therefrom. In accordance with a preferred form, the inner rotor 6 is so constructed that the holder for the container 40 is removable from the centrifuge itself for ease of insertion and removal of the holder 40 outside of the centrifuge.

Figure 4:
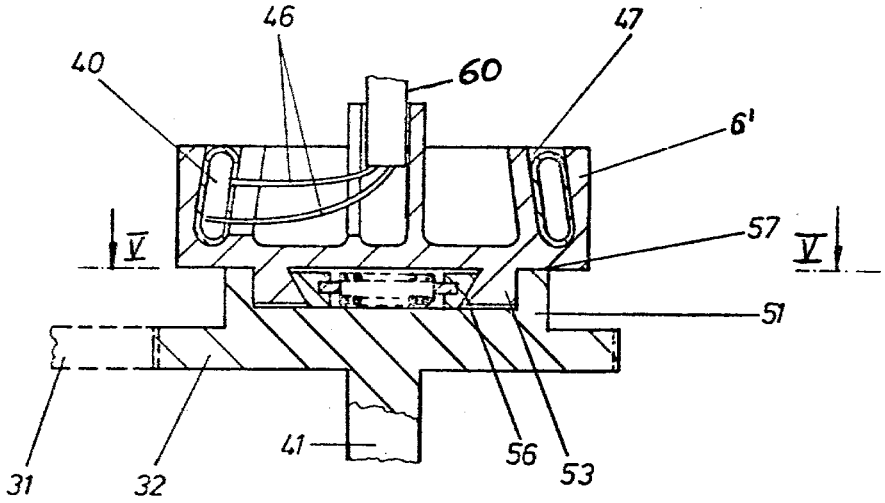
FIG. 4 is a fragmentary view, in vertical section, of a preferred form of location and seating of the innermost rotor, in which only the central portion is shown and only those elements necessary for an understanding of the invention.
Figure 5:
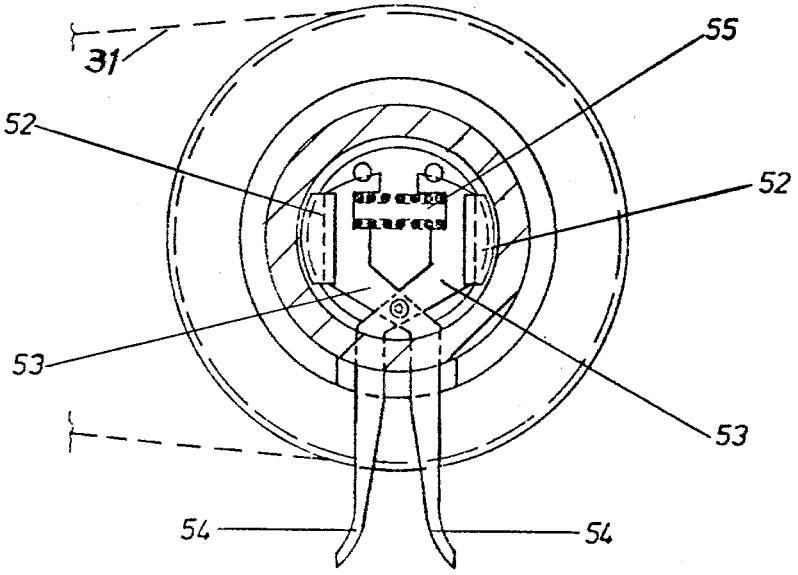
FIG. 5 is a section along the line V—V of FIG. 4.

Referring to FIGS. 4 and 5: The upper portion of the shaft 41 or of the gear 32, respectively, is extended to form an upwardly extending flange 51. The rotor 6' has a depending flange 53 which fits within the upwardly extending flange 51. The flange 53 has an outer circumference which is, essentially, cylindrical. The inner circumference of the flange 53 is formed with an inwardly extending projection which may be straight—as seen in FIG. 4—or may be somewhat bowed, that is, partly spherical. Two relatively movable segments 52 (FIG. 5) can fit into the notch formed by the shape of the inner surface of the flange 53, the segment 52 being spread apart and forced into engagement with the flange surfaces 53 by a spring 55. The elements 53 are connected to scissor-grip handles 54. Upon compression of the finger grips or handles 54 against the force of spring 55, the segments 52 will move towards the center and will release from engagement with the inwardly projecting inclined surfaces 56 to permit the rotor 6' to be lifted off the flange 51. The segments 52 are suitably secured to the gear 32 or the shaft 41, respectively, for example by the pivot pin which also relatively positions the handles 54 (FIG. 5). To insert the rotor, the handles 54 are compressed, the rotor is placed in position against flange 53 and the handles 54 released. Spring 55 then will press the portions 53 of the scissor or the segments 52, respectively, towards the outside, so that the inclined surfaces 56 will come in matching engagement to securely position the rotor on the shaft 41 and to press the surfaces 57 at the end of the flange 53, and on the underside of the rotor element 6', respectively, together. Upon rotation, the effect of the spring 55 is further enhanced by centrifugal forces acting on the segment 52 and the scissor portions of the releasing connection.

The centrifuge, preferably, is used for plasma pheresis; it is not restricted to this use, however.

Operation, particularly for blood separation: A blood donor is positioned close to the centrifuge. During donation, blood is directly conducted over a tube within the centrifuge, which can operate at about 1000 g. The inner rotor 6 retains the separating container 40 which, essentially, is a complete ring shape, and essentially extends over a full circle. The blood supply tube is connected with one end of the container 40. Upon receipt of blood, the blood will distribute in accordance with the centrifugal field over the entire circumference of the container 40. The other end of the container has two further tubes or ducts 46 connected thereto, of which one is radially outwardly, and the other one is connected to a radially inner portion of the container, as described in detail, for example, in German Pat. No. 20 39 898. On the path of the blood from the inlet to the outlet, the centrifugal field causes sedimentation of the heavier components of the blood, that is, the erythrocytes, so that the outermost connecting tubes can be used to take off erythrocytes, whereas the desired plasma, essentially free from erythrocytes, can be taken off the tubular connection closer to the center. The erythrocytes can be returned to the donor immediately after separation from the blood components, by reinfusion, after the erythrocytes have passed through a reinfusion monitoring path.

The plasma is collected in a collector. The donation operation can be used to receive from a donor about 500 ml of plasma.

Connecting and lead-off tubes and ducts can be connected to a container 40 within the inner rotor with a particularly good connection if the ducts are constructed as single tubes or ducts which, however, are bundled together or connected together already within the region of the guidance within the intermediate and the outer rotor to a bundle or multi-duct or multi-tube duct cable. Cabling or bundling of the separate ducts, for example, can be used by introducing the respective individual tubes or ducts into an outer spiral cover, or into other cover elements such as, for example, any suitable protective cover, a braid, a shrink-cover such as a heat shrink tube, or any other outer tube made of plastic, metal, or the like. The outer cover which holds the various individual tubes together in a bundle can extend over the entire length thereof, or only over a selected portion. Preferably, the connecting tubes 46 between the container 40 and a surrounding cover 60 (FIG. 4) are made of soft elastic plastic or rubber.

Various changes and modifications may be made within the scope of the inventive concept.

I claim:

1. Separating centrifuge, particularly for separation of particles suspended in a liquid, and especially for blood fractions, comprising a housing (1);

a drive motor (7);

an outer rotor (4) rotatably journalled and located in the housing;

an intermediate rotor (5) rotatably journalled and located within the outer rotor;

an inner rotor (6, 6') rotatably journalled and located within the intermediate rotor (5);

a separating container (40) located in the inner rotor;

flexible connection means (18, 46) integrally connected to the separating container (40) extending from the container in the inner rotor to a coaxial position within the housing and then through the outer rotor (4) and the housing (1);

first drive connection means (7a, 8, 9, 10) between the drive motor (7) and the outer rotor (4) to drive the outer rotor;

second drive connection means (11–16) between the outer rotor (4) and the intermediate rotor (5);

third drive connection means (27–32) in engagement with the inner rotor (6), and comprising, in accordance with the invention, a synchronizing positive drive connection (25, 33) between the outer rotor (4) and the third drive connection means driving the inner rotor (6).

2. Centrifuge according to claim 1, wherein the third drive connection means comprises a positive drive connection including gear means.

3. Centrifuge according to claim 1, wherein the third drive connection means comprises a drive wheel (27);

and the synchronizing drive connection comprises a pin connection in engagement with the outer rotor (4) and said wheel (27).

4. Centrifuge according to claim 1, wherein the third drive connection means comprises a gear wheel, and the synchronizing positive drive connection includes a connection element (25, 33) securely connecting the outer rotor (4) with said gear wheel (27), for rotary drive of said gear wheel upon rotation of the outer rotor.

5. Centrifuge according to claim 1, wheren said rotors (4, 5, 6) are coaxially positioned within the housing;

and the inner rotor (6) is radially guided in said coaxial position and axially removable from within the intermediate rotor and the outer rotor.

6. Centrifuge according to claim 5, wherein the third drive connection means comprises a wheel element (32) having axially extending positioning means (51) projecting therefrom towards the inner rotor;

the inner rotor (6') is formed with axially projecting means (53) fitting in engagement with said axially projecting elements (52);

and radially movable locking means (52, 53, 55) axially securing the inner rotor (6') in engagement with the axially projecting elements (52) to position the inner rotor on said wheel element (32).

7. Centrifuge according to claim 6, wherein the radially movable locking means comprise radially opposite claws (52) secured to said wheel element and forming with said axially projecting means on the rotor (6') a tongue-and-groove connection.

8. Centrifuge according to claim 6, wherein the radially movable locking means comprises a pair of locking claws (52);

and externally accessible scissor means (54) are provided, to move said claws into and out of engagement with said axially projecting means (53) of the rotor (6').

9. Centrifuge according to claim 1, wheren the inner rotor (6) is shaped with a ring groove or ring-shaped opening, and said container is an essentially ring-shaped element fitting within said ring-shaped opening;

and at least two connecting tubes (46) are connected from said ring-shaped container to extend owtwardly from the rotor housing and free from torsional stresses, and for connection to an external container.

10. Centrifuge according to claim 9, wherein the connecting tubes are of soft elastic material comprising at least one of: rubber; plastic.

11. Centrifuge according to claim 10, further including an outer protective tube (60) surrounding said connecting tubes.

12. Centrifuge according to claim 11, wherein the outer surrounding protective cover comprises at least one of: a braid; a shrink tube; a plastic tube; a metal spiral.

13. Centrifuge according to claim 11, wherein the outer protective tube extends at least over a portion of the length of said connecting tubes.

14. Centrifuge according to claim 1, wherein the third drive connection means comprises a gear wheel, and the synchronizing positive drive connection includes a connection element (25, 33) secured connecting the outer rotor (4) with said gear wheel (27), for rotary drive of said gear wheel upon rotation of the outer rotor;

wherein the third drive connection means comprises a wheel element (32) having axially extending positioning means (51) projecting therefrom towards the inner rotor;

the inner rotor (6') is formed with axially projecting means (53) fitting in engagement with said axially projecting elements (52);

wherein the inner rotor (6) is shaped with a ring groove or ring-shaped opening, and said container is an essentially ring-shaped element fitting within said ring-shaped opening;

at least two connecting tubes (46) are connected from said ring-shaped container to extend outwardly from the rotor housing and free from torsional stresses, and for connection to an external container;

and further including an outer protective tube (60) surrounding said connecting tubes.

* * * * *